US008690091B2

(12) United States Patent
Scholz et al.

(10) Patent No.: US 8,690,091 B2
(45) **Date of Patent: *Apr. 8, 2014**

(54) ROLLER WITH DRIVEN GRINDING ROLLER

(76) Inventors: Guido Scholz, Münster (DE); Pedro Guerrero Palma, Lippetal (DE); Heiko Fornefeld, Hamm (DE); Ludwig Könning, Ahlen (DE); Franz-Josef Zurhove, Waldshut-Tiengen (DE); Helmut Krumme, Wadersloh (DE)

( * ) Notice: Subject to any disclaimer, the term of this patent is extended or adjusted under 35 U.S.C. 154(b) by 431 days.

This patent is subject to a terminal disclaimer.

(21) Appl. No.: 13/055,797

(22) PCT Filed: Aug. 24, 2009

(86) PCT No.: PCT/EP2009/060879

§ 371 (c)(1),
(2), (4) Date: Jan. 25, 2011

(87) PCT Pub. No.: WO2010/023184

PCT Pub. Date: Mar. 4, 2010

(65) Prior Publication Data

US 2011/0114771 A1 May 19, 2011

(30) Foreign Application Priority Data

Aug. 25, 2008 (DE) ..... 10 2008 039 543

(51) Int. Cl.
*B02C 19/00* (2006.01)

(52) U.S. Cl.
USPC ..... 241/101.2; 241/121

(58) Field of Classification Search
USPC ..... 241/101.2, 117–121
See application file for complete search history.

(56) References Cited

U.S. PATENT DOCUMENTS

| | | | | |
|---|---|---|---|---|
| 2,337,884 | A * | 12/1943 | Haefeli | 74/391 |
| 3,174,302 | A * | 3/1965 | Pomper | 464/154 |
| 4,896,837 | A | 1/1990 | Heinemann et al. | |
| 2001/0028006 | A1* | 10/2001 | Schmitt | 241/101.2 |
| 2011/0240779 | A1* | 10/2011 | Berndzen et al. | 241/227 |

FOREIGN PATENT DOCUMENTS

| | | | |
|---|---|---|---|
| DE | 295563 | C | 12/1916 |
| DE | 3602932 | | 8/1987 |
| DE | 19702854 | | 7/1998 |
| RU | 1346238 | A1 | 12/1998 |

OTHER PUBLICATIONS

Machine translation for DE 3602932.*

* cited by examiner

*Primary Examiner* — Shelley Self
*Assistant Examiner* — Leonel Vasquez
(74) *Attorney, Agent, or Firm* — Renner Kenner Greive Bobak Taylor & Weber

(57) ABSTRACT

A roller mill includes a rotatable grinding table, at least one grinding roller retained rotatably on a pivot lever and in rolling engagement with the grinding table, the pivot lever being pivotable about a pivot lever axis, and at least one drive train connected to the grinding roller and having a fixed motor and a fixed gearing mechanism. The drive train further has a gearing mechanism which pivots with the pivot lever and/or the grinding roller.

16 Claims, 2 Drawing Sheets

ROLLER WITH DRIVEN GRINDING ROLLER

TECHNICAL FIELD

The invention relates to a roller mill having a rotatable grinding table and at least one grinding roller which is retained rotatably on a pivot lever and which is in rolling engagement with the grinding table, the pivot lever being arranged for pivoting about a pivot lever axis.

BACKGROUND OF THE INVENTION

In roller mills used industrially, there is generally driven the grinding table which drives the grinding rollers via the grinding bed. In this instance, it is generally necessary to arrange a gearing mechanism below the grinding table. In mills having large throughputs, it is necessary to take into account high investment costs, long procurement times and unsatisfactory availability with such gearing mechanisms.

Therefore, it has already been proposed to drive the grinding rollers in place of the grinding table. If a plurality of grinding rollers are provided, it is thereby possible to distribute the power for driving the roller mill over a corresponding plurality of drives. In that manner, it is possible to use drives which are smaller and therefore cheaper.

In DE 38 01 728 C2 and DE 36 02 932 A1, the complete drive with the motor and gearing mechanism is provided on the pivot lever which retains the grinding roller. Owing to the substantial weight of the drive, however, increased demands are placed on the bearing of the pivot lever in this construction type. The motor is further subjected to powerful vibrations owing to the grinding process.

DE 197 02 854 proposes a motor which is fixed in position as an alternative construction type. The drive power is transmitted to the gearing mechanism which is secured to the pivot lever via a cardan shaft. That cardan shaft has to ensure both angular compensation and longitudinal axial compensation. However, since very high torques have to be transmitted to the grinding roller, the drive train has to have such dimensions that it is relatively complex and expensive.

DE 295 563 further discloses an edge mill having a driven table and an edge runner which is retained by means of a pivot lever. The drive of the edge runner is brought about via a fixed motor and a gearing mechanism which pivots with the pivot lever, the pivoting gearing mechanism extending into the edge runner.

SUMMARY OF THE INVENTION

Therefore, an object of the invention is to construct the drive of the roller mill more cheaply.

This object is achieved according to the invention by the features of claim 1.

The roller mill according to the invention substantially comprises a rotatable grinding table, at least one grinding roller which is retained rotatably on a pivot lever and which is in rolling engagement with the grinding table, the pivot lever being pivotable about a pivot lever axis, and at least one drive train which is connected to the grinding roller and which has a fixed motor and a fixed gearing mechanism. The drive train further has a gearing mechanism which pivots with the pivot lever and/or the grinding roller.

The two gearing mechanisms are preferably connected to each other via an angularly adjustable and/or axially adjustable shaft.

Using at least two gearing mechanisms allows transmission ratios which allow a motor output speed of from 1000 to 3000 rpm. The investment costs necessary for the motors can be reduced by rapidly rotating motors. If a portion of the transmission work is carried out by a fixed gearing mechanism, on which no particular requirements are placed, it is possible to use a gearing mechanism which is standardised and consequently cheap. Owing to the pivoting gearing mechanism, the torque in the angularly and/or radially axially adjustable shaft is reduced by the factor of the transmission of the pivoting gearing mechanism. It is thereby possible to bring about movement compensation by means of standardised components. For instance, it is possible to compensate for that component, for example, with a tooth coupling, and the rotational movement can thereby be transmitted homokinetically.

According to a preferred embodiment of the invention, the pivoting gearing mechanism is an epicyclic gear system, in particular a power-splitting gearing mechanism which can be formed, for example, by a planet gear system. That pivoting gearing mechanism can also be integrated in the grinding roller or secured to the grinding roller.

The pivot lever is arranged in a bearing, it being possible to arrange the pivoting gearing mechanism upstream or downstream of the bearing in the drive train.

The pivot lever may be in the form of a hollow shaft, a portion of the drive train being arranged in the hollow shaft.

The drive train can further have a coupling which is arranged in the pivot lever axis or the extension thereof and which compensates for the pivot movement of the pivot lever. That coupling may be in the form of, for example, a tooth coupling, in particular a curved-tooth coupling, or a cardan shaft.

BRIEF DESCRIPTION OF THE DRAWINGS

Other advantages and embodiments of the invention will be explained in greater detail below with reference to the description and the drawings, in which.

DETAILED DESCRIPTION OF THE INVENTION

Figure 1:
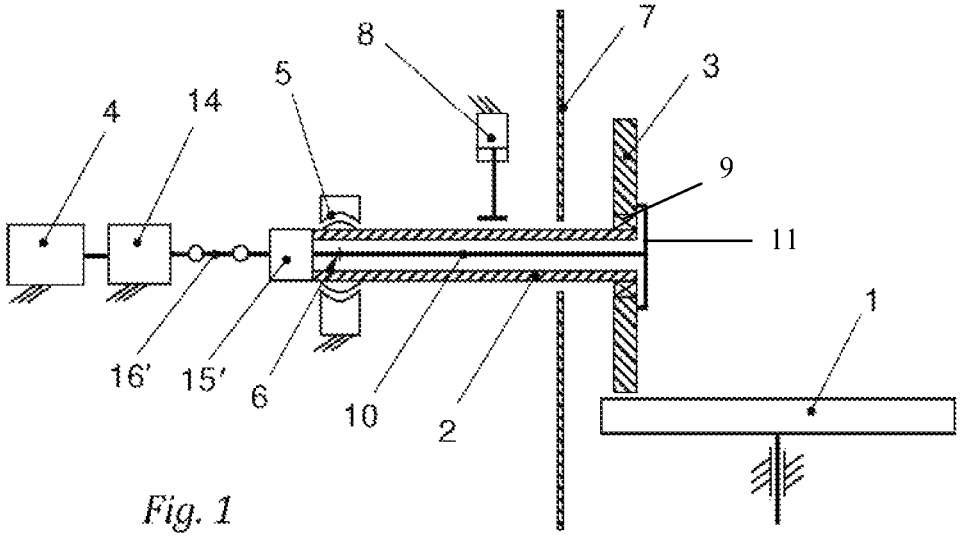
FIG. 1 is a schematic illustration of a roller mill according to a first embodiment.

The roller mill illustrated in FIG. 1 substantially comprises a rotatable grinding table 1, at least one grinding roller 3 which is rotatably retained on a pivot lever 2 and a drive train associated with the grinding roller for driving the grinding roller with a motor 4 which is fixed in position. The pivot lever is arranged in a bearing 5 for pivoting about a pivot lever axis 6. The pivot lever 2 further extends through a mill housing 7, the grinding roller 3 being retained at the end of the pivot lever in the mill housing whereas the other end is arranged in the bearing 5 outside the mill housing.

There is further provided a pressing system 8, in particular a hydropneumatic resilient system, in order to adjust the pressing pressure of the grinding roller 3. The pressing system is also arranged outside the mill housing 7 and is in operational contact with the pivot lever.

The grinding roller 3 is arranged for rotation on the pivot lever 2 by means of a grinding roller bearing 9. The pivot lever 2 is further constructed as a hollow shaft so that a portion of the drive train is arranged in the form of a drive shaft 10 in the hollow shaft. The rotational movement of the drive shaft is transmitted to the grinding roller 3 via a hub 11.

The drive shaft 10 is operationally connected, at the other end, to the motor 4 which is arranged so as to be fixed in position, at least one fixed gearing mechanism 14 and one gearing mechanism 15' which pivots with the pivot lever 2 being interposed.

There is provided between the two gearing mechanisms 14 and 15' a radially and axially adjustable shaft 16' for transmitting the rotational movement and for compensating for the pivot movement of the pivot lever 2. That shaft 16' may, for example, be in the form of a cardan shaft. Owing to the gearing mechanism being divided into a fixed gearing mechanism 14 and a gearing mechanism 15' which pivots with the pivot lever 2, the shaft 16' can have correspondingly smaller dimensions because the main torque has to be transmitted only downstream of the pivoting gearing mechanism 15'.

Figure 2:
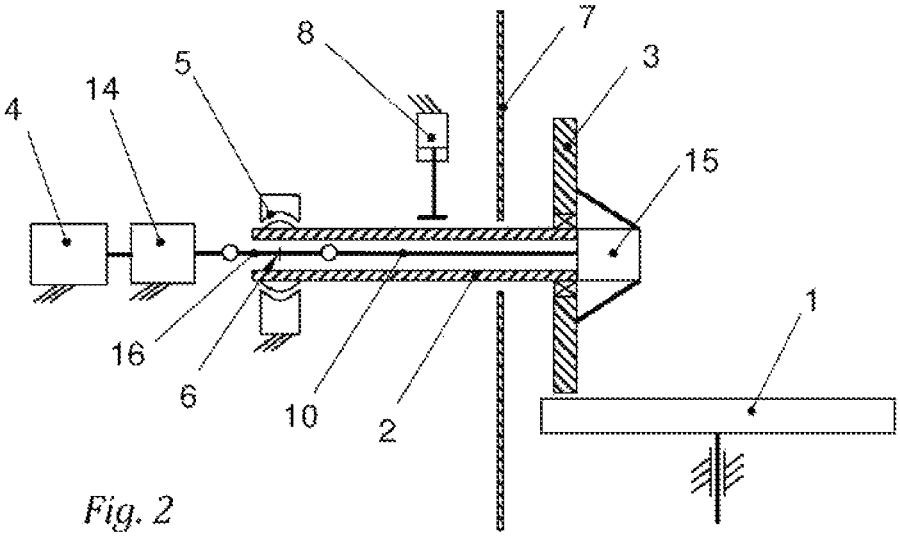
FIG. 2 is a schematic illustration of a roller mill according to a second embodiment.

Whereas, in the first embodiment, the pivoting gearing mechanism 15' is arranged in the region of the bearing 5 of the pivot lever 2, according to the second embodiment in FIG. 2, it is located in the grinding chamber, that is to say, in the mill housing 7. The pivoting gearing mechanism 15 according to FIG. 2 is arranged at the end-face end of the pivot lever 2 in the mill housing 7 and is connected to the grinding roller 3.

According to an alternative embodiment, the pivoting gearing mechanism could also be integrated in the grinding roller. Owing to the pivoting gearing mechanism being arranged in the region of the grinding roller, the great torques are produced precisely where they are required. It is thereby possible for the drive train which extends as far as the pivoting gearing mechanism 15 to be produced correspondingly more favourably and readily to be procured. The mass moment of inertia is further reduced owing to the reduction of the masses in the drive train. This in turn makes it easier to adjust and control the drive. The drive elements are subjected to acceleration forces owing to the grinding process so that the reduction in mass also has a positive effect on the configuration and durability of the bearings in this instance.

In order to be able to compensate for the pivot movement of the pivot lever 2 in the drive train, the shaft 16 may be provided in the region of the bearing 5 so that it is also possible in some circumstances to dispense with axial adjustability of the shaft and the shaft 16 only has to ensure angular adjustability.

In the arrangement according to FIG. 2, it would also be possible to provide a coupling in place of the angularly and/or radially axially adjustable shaft 16. The coupling is preferably further arranged in the axis of rotation 6 of the pivot lever. The coupling 12 can be constructed by a torsionally rigid compensation coupling, in particular a curved-tooth coupling, because the great torques are produced only at the pivoting gearing mechanism 15.

A special construction of the second embodiment is explained in greater detail below with reference to FIG. 3.

Figure 3:
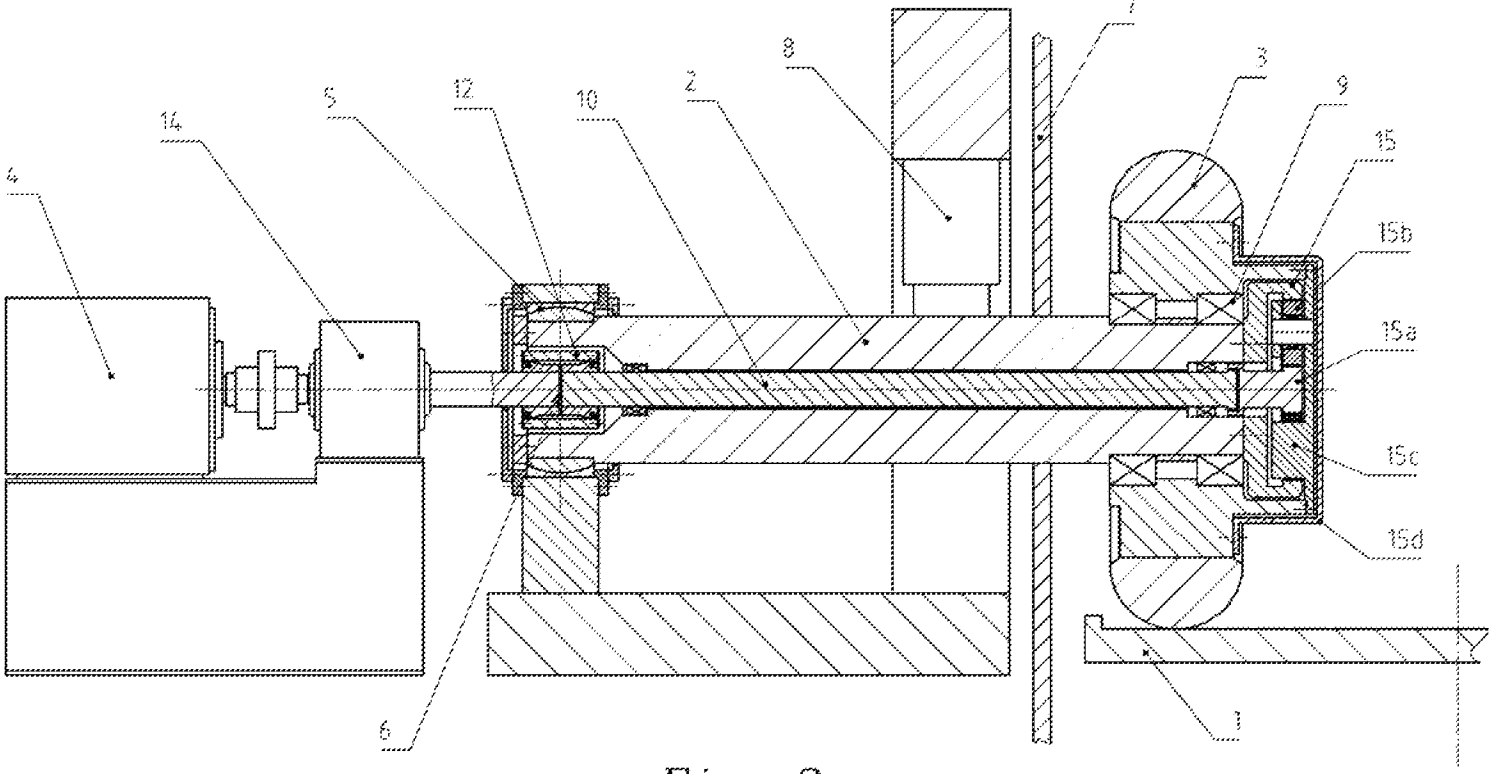
FIG. 3 is a partially sectioned side view of the roller mill in a special variant of the second embodiment.

In the embodiment according to FIG. 3, the pivoting gearing mechanism 15 is in the form of an epicyclic gear system. It is secured to the end of the pivot lever 2 in the region of the grinding roller 3 and is in the form of a power-splitting gearing mechanism, in particular in the form of a planet gear system.

The epicyclic gear system has, as usual, a sun gear 15*a*, a plurality of planet gears 15*b* and a planet carrier 15*c*. The sun gear 15*a* may be arranged for pivoting movement and is driven via the drive shaft 10. The planet carrier is connected to the grinding roller 3 in a rotationally secure manner. The epicyclic gear system is further protected by means of a wear protection member 15*d* which can preferably be changed. There is further intended to be provided a suitable moment support which could be formed, for example, by lateral guides of the pressing system 8.

Since a portion of the drive train is constructed so as to be fixed in position and another portion, in particular the drive shaft 10 which is arranged in the pivot lever 2, pivots with the pivot lever 2, there is further provided a coupling 12 which compensates for the pivot movement of the pivot lever. There is preferably used a coupling 12 which is arranged in the axis of rotation 6 of the pivot lever and which transmits the rotational movement homokinetically.

The coupling 12 is a torsionally rigid compensation coupling, it being possible to provide in particular a curved-tooth coupling.

According to another construction of the invention, the grinding roller bearing 9, the bearing 5 and the coupling 12 have a common oil chamber.

By the gearing mechanism being divided into at least one fixed gearing mechanism and at least one pivoting gearing mechanism, it is possible to construct the drive train between the two gearing mechanisms by means of standardised components owing to the reduced torque at that location. If the pivoting gearing mechanism is further located in the grinding chamber, that is to say, in the region of the grinding roller, there may be provided a drive train having reduced torque and reduced mass.

The invention claimed is:

1. Roller mill comprising:

a. a rotatable grinding table, b. at least one grinding roller retained rotatably on a pivot lever and in rolling engagement with the grinding table, the pivot lever being pivotable about a pivot lever axis, c. and at least one drive train connected to the grinding roller and having a fixed motor and a fixed gearing mechanism, characterised in that the drive train further has a gearing mechanism which pivots with the pivot lever and/or the grinding roller.

2. Roller mill according to claim 1, characterised in that the gearing mechanism which pivots is in the form of an epicyclic gear system.

3. Roller mill according to claim 1, characterised in that the gearing mechanism which pivots is in the form of a power-splitting gearing mechanism.

4. Roller mill according to claim 1, characterised in that the gearing mechanism which pivots is in the form of a planet gear system.

5. Roller mill according to claim 2, characterised in that the gearing mechanism which pivots is secured to the grinding roller.

6. Roller mill according to claim 1, characterised in that the gearing mechanism which pivots and the fixed gearing mechanism are connected to each other via an angularly adjustable coupling.

7. Roller mill according to claim 1, characterised in that the gearing mechanism which pivots and the fixed gearing mechanism are connected to each other via an angularly and axially adjustable shaft.

8. Roller mill according to claim 6, characterised in that the pivot lever is arranged in a bearing between the gearing mechanism which pivots and the fixed gearing mechanism and the angularly adjustable coupling is provided in the region of the bearing.

9. Roller mill according to claim 1, characterised in that the pivot lever is arranged in a bearing and the gearing mechanism which pivots is arranged upstream of the bearing in the drive train.

10. Roller mill according to claim 1, characterised in that the pivot lever is in the form of a hollow shaft and a portion of the drive train is arranged in the hollow shaft.

11. Roller mill according to claim 1, characterised in that the drive train has a coupling which is arranged in the pivot lever axis or the extension thereof and which compensates for the pivot movement of the pivot lever.

12. Roller mill according to claim 11, characterised in that the coupling is in the form of a curved-tooth coupling.

13. Roller mill according to claim 11, characterised in that the angularly and axially adjustable shaft is in the form of a cardan shaft.

14. Roller mill according to claim 1, characterised in that the pivot lever extends through a mill housing and the grinding roller is retained on the end of the pivot lever in the mill housing whereas the other end is arranged in a bearing outside the mill housing.

15. Roller mill according to claim 1, characterised in that a pressing system which is in operational contact with the pivot lever is provided in order to adjust the pressing pressure of the grinding roller.

16. Roller mill according to claim 1, characterised in that the pivot lever is arranged in a bearing and the fixed gearing mechanism is arranged downstream of the bearing in the drive train.

* * * * *